United States Patent [19]

Muntjanoff et al.

[11] 4,140,233

[45] Feb. 20, 1979

[54] LOAD SKIDDING VEHICLE WITH WEIGHT TRANSFERRING GRAPPLE

[75] Inventors: John R. Muntjanoff; Eugene M. Poplawski, both of Aurora; Kenneth W. Timmons, Plano, all of Ill.

[73] Assignee: Caterpillar Tractor Co., Peoria, Ill.

[21] Appl. No.: 754,783

[22] Filed: Dec. 27, 1976

[51] Int. Cl.[2] ..... B66C 1/68

[52] U.S. Cl. ..... 214/147 AS; 280/179 R; 294/106

[58] Field of Search ..... 214/147 AS, 654, 147 G, 214/DIG. 3, DIG. 4, DIG. 6; 212/7; 280/179 R; 294/106

[56] References Cited

U.S. PATENT DOCUMENTS

| | | | |
|---|---|---|---|
| 2,873,874 | 2/1959 | Best | 214/654 |
| 3,064,840 | 11/1962 | Ilon | 214/147 AS X |

FOREIGN PATENT DOCUMENTS

| | | | |
|---|---|---|---|
| 201822 | 3/1968 | U.S.S.R. | 214/147 AS |

*Primary Examiner*—Albert J. Makay
*Assistant Examiner*—George F. Abraham
*Attorney, Agent, or Firm*—Wegner, Stellman, McCord, Wiles & Wood

[57] ABSTRACT

A load skidding vehicle including a vehicle frame and front and rear wheels on the frame. A grapple mechanism is mounted on the frame and includes a grapple outside of the periphery of the frame for partially lifting a load to be skidded across the ground. A force applying member is carried by the frame for applying a force having a substantial downward component to a load grasped by the grapple at a point spaced from the point of engagement of the load with the grapple and remote from the frame to thereby provide a reactive force tending to equalize the weight distribution on the wheels of the vehicle.

8 Claims, 2 Drawing Figures

LOAD SKIDDING VEHICLE WITH WEIGHT TRANSFERRING GRAPPLE

BACKGROUND OF THE INVENTION

This invention relates to load skidding vehicles as, for example, vehicles having grapples thereon for skidding logs across the ground in timber harvesting operations.

In timber harvesting operations, it is often necessary to move logs over rough terrain from the point whereat they were felled to a distant point whereat they may be loaded on a vehicle, train, or the like, or conveyed by other means to a point of use.

In some cases, such movement has been accomplished simply by attaching the log to a vehicle which then drags the log over the ground to its destination. More frequently, the movement has been accomplished through the use of specialized vehicles having grapples which grasp and lift one end of the log prior to the log being skidded across the ground. Such vehicles with grapples have worked well for their intended purposes. However, because the weight of the log is often substantial, and the point of engagement of the grapple with the log is outside of the periphery of the vehicle frame, that part of the ground engaging means of the vehicle nearest to the log is considerably more heavily loaded than the part of the ground engaging means remote from the log. As a consequence, particularly when the vehicle is being operated over rough terrain, there exists the possibility of overloading parts of the vehicle due to the unequal weight distribution as well as the possibility that an unstable vehicle condition may be generated.

SUMMARY OF THE INVENTION

The present invention is directed to overcoming one or more of the problems as set forth above.

According to the present invention, there is provided a grapple structure for grasping an elongate load and a means for applying a force having a substantial downward component to a log grasped by the grapple at a point spaced therefrom. The force applying means provides a reactive force so that when the grapple mechanism is utilized in connection with a vehicle, equalized weight distribution will result.

Other objects and advantages will become apparent from the following specification taken in connection with the accompanying drawings.

DESCRIPTION OF THE PREFERRED EMBODIMENT

Figure 1:
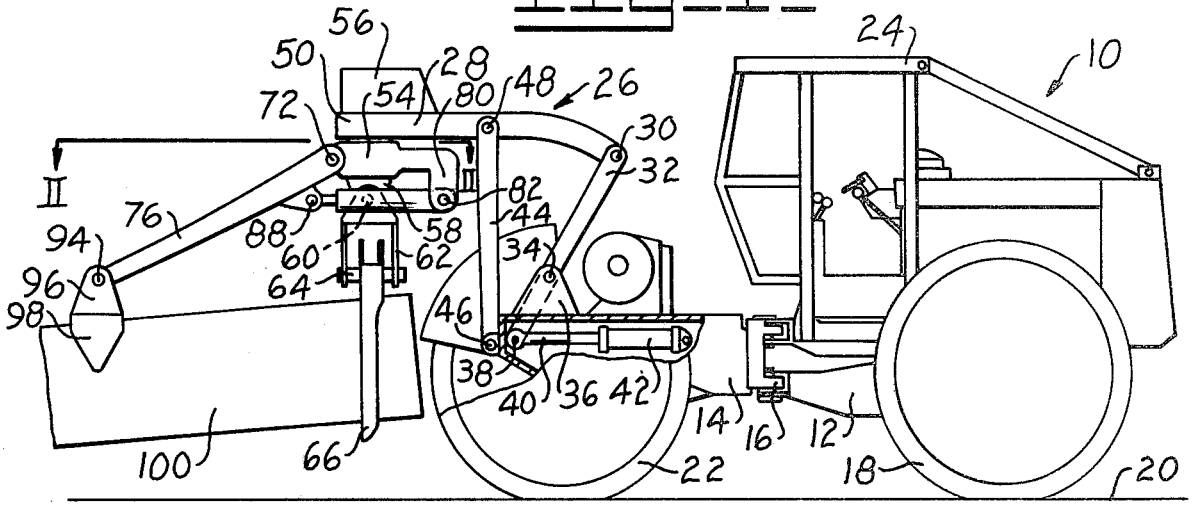
FIG. 1 is a side elevation of a load skidding vehicle made according to the invention.

An exemplary embodiment of the invention is employed in connection with a vehicle, generally designated 10, of the articulated type. The vehicle 10 includes a front frame 12 and a rear frame 14 interconnected by connecting means 16 which may be of conventional construction well known in the art of articulated vehicles.

The front frame 12 mounts a pair of spaced front wheels 18 for engaging the underlying terrain 20 while the rear frame 14 similarly mounts rear wheels 22. The front frame 12 also supports an operator cab 24 for housing the operator of the vehicle.

The rear frame 14 serves as a base for a grapple boom, generally designated 26. The grapple boom 26 includes a generally horizontally extending arm 28 having one end pivotally secured as at 30 to a link 32. The link 32 is pivoted as at 34, intermediate its ends, to upstanding tongues 36 (only one of which is shown) on the rear frame 14. The lower end of the link 32 is pivoted as at 38 to the rod 40 of a hydraulic cylinder 42 secured to the frame 14 by any suitable means. A second link 44 has its lower end pivoted as at 46 to the rear frame 14 and its upper end pivoted at 48 to the arm 28. As a consequence of the foregoing, retraction of the rod 40 of the cylinder 42 will cause the arm 28 of the boom to move downwardly and rearwardly of the frame 14 while extension of the rod 40 will cause the opposite movement to occur.

An end 50 of the arm 28 extends beyond the rearwardmost extent of the frame 14 and receives the upstanding end 52 of a sleeve secured to the upper surface of a yoke 54. Suitable bearings (not shown) are employed along with retaining means whereby the yoke 54 is journalled on the end of the arm 28 for rotation about a substantially vertical axis. If desired, suitable motive means, indicated schematically at 56, can be employed to rotate the yoke 54 about the above mentioned axis.

The yoke 54 includes depending ears 58 which receive a pivot pin 60 to pivot a bifurcated connector 62 on the yoke 54 in depending relation. The bifurcated connector 62, at its lower end, receives a pivot pin 64 which extends generally horizontally to pivot opposed jaws 66 and 68 of a conventional grapple. While not shown herein, it is contemplated that motive means, such as hydraulic cylinders, may be employed to open and close the grapple jaws 66 and 68.

Figure 2:
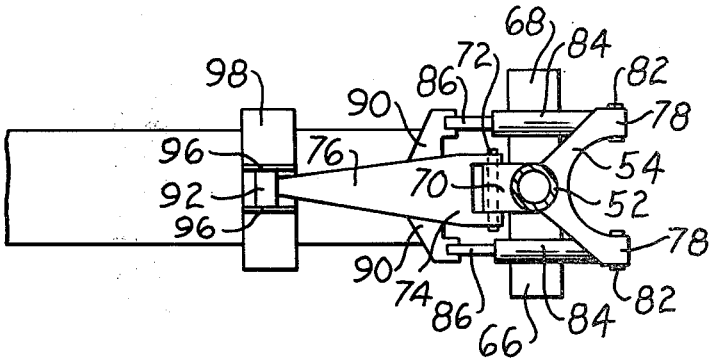
FIG. 2 is a horizontal sectional view taken approximately along the line 2—2 of FIG. 1.

As best seen in FIG. 2, the yoke 54 is Y-shaped and its base 70 receives a horizontally extending pivot pin 72 by which an end 74 of a spring arm 76 is pivoted to the yoke 54. Each of the upper arms of the Y-shaped yoke 54 include depending tongues 80 which receive horizontally extending pivot pins 82 connected to one end of respective hydraulic cylinders 84. It is to be noted that the location of the pivot pins 82 is below that of the pivot pin 72. The rod ends 86 of the cylinders 84 are pivotally connected by pins 88 to oppositely extending arms 90 secured to the underside of the spring arm 76.

As a consequence of the foregoing interrelationship, retraction of the rods 86 of the cylinders 84 will cause the spring arm 76 to be urged downwardly. Preferably, the cylinders 84 are double acting so that motive power is provided for raising the spring arm 76.

The end of the spring arm 76 remote from the pivot pin 72 terminates in a sleeve 92 which in turn receives a pivot pin 94 extending between spaced plates 96 extending upwardly from a force applying member 98 which is arcuate in configuration and concave downwardly. The force applying member 98 is adapted to embrace the upper side of a log 100 or the like at a location spaced from the grapple jaws 96 and on the side thereof remote from the vehicle 10. When the cylinders 84 are operated to retract their rods 86, it will be appreciated that a downward force will be applied to the log 100 intermediate its ends. As a consequence, an upward reaction will be generated at the pivot 72 which will be in opposition to the downward force exerted on the vehicle at the grapple jaws 66. By suitably regulating the degree of the force, the loading force on the rear wheels 22 of the vehicle due to the weight of the log 100 may be wholly or partially compensated for thereby moving the weight distribution of the vehicle and the load forwardly with respect to the vehicle frame. As a consequence, any desired weight distribution on the wheels 18 and 22 may be attained.

It is to be noted that it is highly desirable that the force applying means include shock absorbing means within the system. In the embodiment illustrated, the fact that the arm 76 is a spring arm provides such shock absorbing means. Such shock absorbing means are highly desired in that when a load such as the log 100 is being skidded across rough terrain, the position of its end remote from that grasped by the grapple jaws 66 and 68 with respect to the vehicle will be constantly changing due to its passage over rocks, logs, stumps, or the like. The provision of such shock absorbing means absorbs mechanical shocks placed on the system due to such movement.

In a highly preferred embodiment, the vehicle will be of the four-wheel drive type. Through use of the invention, loading may be distributed such that maximum traction at all drive wheels is attained. Consequently, because traction is maximized, a given vehicle employing the invention will have an increased drag capacity over prior art constructions.

From the foregoing, it will be appreciated that a grapple structure made according to the invention provides means whereby overloading a part of the ground engaging means, here, the rear wheels 22, can be avoided. It will also be appreciated that, at the same time, by selecting an appropriate weight distribution, the possibility of generating an unstable condition in the vehicle can be avoided, even when the vehicle is traveling over rough terrain.

It should also be observed that, as used herein, the term "grapple" is used in its broadest sense and should not be limited, unless specified, to jaws. For example, the advantages of the invention can be realized through the use of a grapple in as simple a form as a chain or cable wrapped around an end of an elongated load and secured to the boom 26.

What is claimed is:

1. A vehicle comprising:

a vehicle frame;

ground engaging means on said frame;

a grapple mechanism having a grapple for grasping loads to be skidded across the ground;

a grapple boom mounting said grapple mechanism and movably connected to said frame by rigid link means horizontally pivoted to said frame and to said boom;

motor means for swinging said boom on said link means to raise and lower said boom; and means carried by said frame for applying a force having a substantial downward component to a load grasped by the grapple at a point spaced from the point of engagement of the load with the grapple, whereby when a force is applied to a load, weight distribution of the load on the frame may be altered;

said link means comprising a pair of inextensible links each pivoted to said boom at spaced locations.

2. The vehicle of claim 1 wherein said force applying means includes shock absorbing means.

3. The vehicle of claim 2 wherein said shock absorbing means comprises a spring arm.

4. The vehicle of claim 1 wherein said motor means is connected to one of said links.

5. A vehicle comprising:

a vehicle frame;

ground engaging means on said frame;

a grapple mechanism having a grapple for grasping loads to be skidded across the ground;

a grapple boom mounting said grapple;

an inextensible, elongated, rigid link having opposed ends, one of said ends being pivoted to said boom at a first pivot axis, the other of said ends being pivoted to said frame at a second pivot axis, said first and second pivot axes being generally parallel and spaced from each other;

motor means interconnecting said boom and said frame at locations spaced from said first and second pivot axes and operative to pivot said boom on said link about said first pivot axis while pivoting said link on said frame about said second pivot axis; and means carried by said boom for applying a force having a substantial downward component to a load grasped by the grapple at a point spaced from the point of engagement of the load with the grapple.

6. The vehicle of claim 5 wherein said motor means comprises a hydraulic cylinder and an additional rigid, inextensible link pivoted to said boom and to said frame.

7. The vehicle of claim 5 wherein said boom is adjacent an end of said frame.

8. The vehicle of claim 5 wherein said force applying means comprises a spring arm.

* * * * *